United States Patent [19]

Atherton et al.

[11] 4,037,670

[45] July 26, 1977

[54] MOTOR GRADER WITH BLADE CLAMPING MECHANISM

[75] Inventors: Robert Allan Atherton, Chillicothe; Carroll Richard Cole, Decatur, both of Ill.

[73] Assignee: Caterpillar Tractor Co., Peoria, Ill.

[21] Appl. No.: 696,160

[22] Filed: June 14, 1976

[51] Int. Cl.[2] ..... E02F 3/76; A01B 65/02

[52] U.S. Cl. ..... 172/795; 92/118; 172/305; 172/476; 172/667; 172/673; 172/741; 188/41

[58] Field of Search ..... 172/272, 273, 274, 275, 172/305, 476, 507, 667, 673, 719, 741, 743, 747, 767, 781, 782, 789, 791, 792, 793, 795, , 796, 797; 214/138 C, 145 A; 280/456 R, 460 R, 461 R; 403/110; 188/41; 92/75, 117 R, 118; 91/217; 74/527, 577 S

[56] References Cited

U.S. PATENT DOCUMENTS

| | | | |
|---|---|---|---|
| 2,258,890 | 10/1941 | Gustafson | 172/793 |
| 3,593,806 | 7/1971 | Gurries | 172/741 |
| 3,699,851 | 10/1972 | Kennedy | 92/118 X |
| 3,877,349 | 4/1975 | Schindel | 92/75 X |
| 3,891,065 | 6/1975 | Iijima et al. | 188/41 |
| 3,945,300 | 3/1976 | Bourges | 92/75 X |
| 3,983,945 | 10/1976 | Hart et al. | 172/795 |

*Primary Examiner*—Richard T. Stouffer
*Attorney, Agent, or Firm*—Wegner, Stellman, McCord, Wiles & Wood

[57] ABSTRACT

An improved blade clamping mechanism for a motor grader blade which has blade support rails carried in pivoted blade support means for lateral sliding movement, and in which confining surfaces in the blade support means restrict both vertical and fore-and-aft movement of the rails in the support means. A clamp lever is pivoted on the circle of the motor grader and has a clamp arm which can be turned in a vertical plane against the bottom of the lower support rail with a high mechanical advantage to force the rail against an overlying confining surface; and a single action hydraulic cylinder and piston unit which turns the lever simultaneously presses a clamp shoe against the rear of the upper support rail. The clamps are normally locked by hydraulic pressure on the piston, and released by moving a manually controlled valve to a drain position so that a return spring acting on the clamp shoe can move the shoe and the lever to a release position.

14 Claims, 5 Drawing Figures

Fig. 1
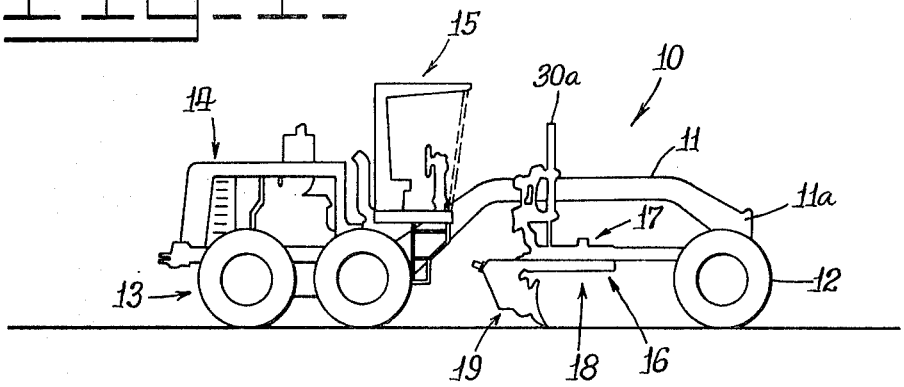
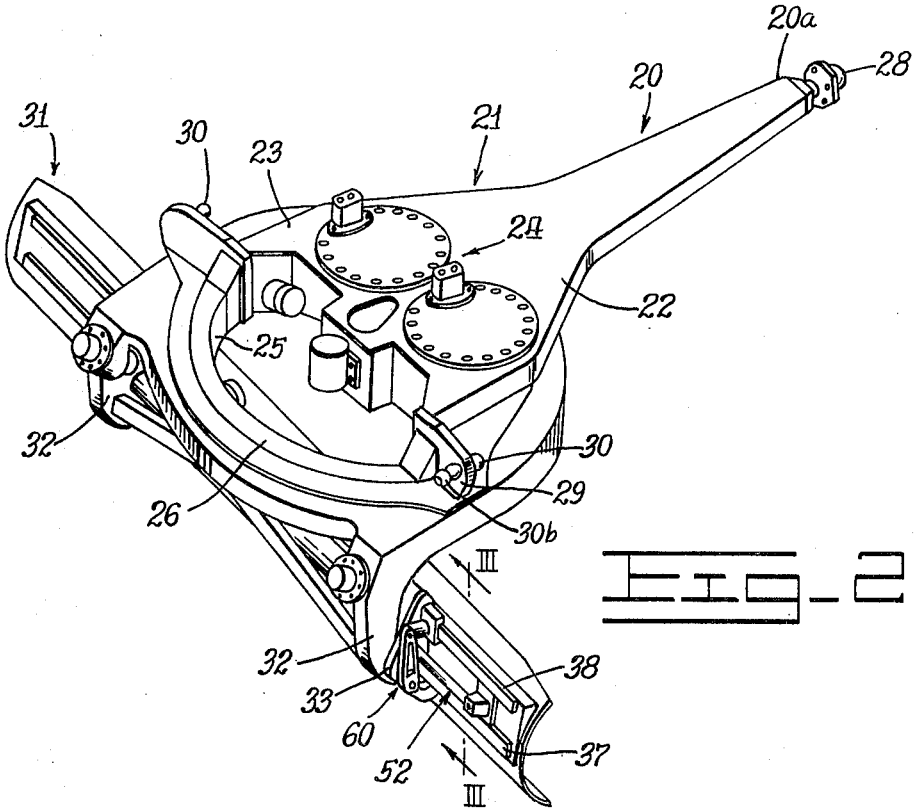
Fig. 2
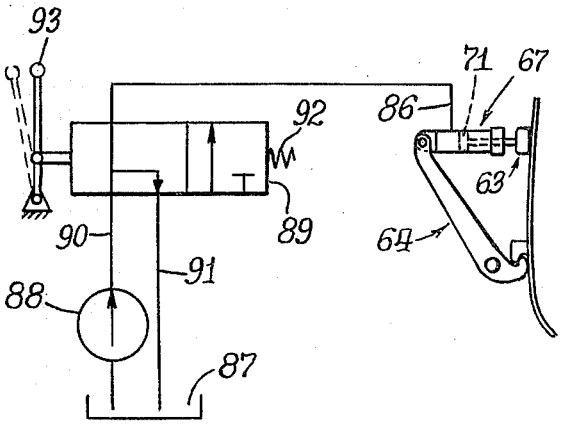
Fig. 5

MOTOR GRADER WITH BLADE CLAMPING MECHANISM

CROSS REFERENCE TO RELATED APPLICATIONS

Details of the draw bar structure and of the circle mounting bar and circle assembly which are illustrated and described generally in this application are described in detail and claimed in copending U.S. Patent applications of Carroll Richard Cole, Ser. Nos. 661,880, filed Feb. 27, 1976 and Ser. No. 663,594, filed Mar. 3, 1976.

The blade structure which is illustrated and described generally in this application is described in detail and claimed in copending U.S. Pat. application of Carroll Richard Cole Ser. No. 696,161, filed Jun. 14, 1976.

The blade mounting and the interrelationship between said mounting and the blade which is disclosed in this application is disclosed and claimed in copending U. S. Pat. application of Carroll Richard Cole, Ser. No. 696,163, filed Jun. 14, 1976.

BACKGROUND OF THE INVENTION

Motor graders have a longitudinal main frame which has a dirigible wheel assembly at its forward end, an operator's cab at its rearward end portion, and a traction chassis for the motor and power train behind the cab. The motor grader blade is suspended from the main frame by means of a circle draw bar and a circle. The circle draw bar has its front end connected to the front of the main frame by a ball and socket connection, while the rearward portion of the circle draw bar is suspended from the main frame by hydraulic cylinder and piston means which permit the draw bar to swing in a vertical plane about its front end.

The circle is mounted on the rearward portion of the circle draw bar for rotation about a vertical axis, and there is a driving interconnection between a motor on the circle draw bar and a ring gear on the circle to effect such rotary motion of the circle.

The grader blade is mounted upon the circle so that rotation of the circle changes the angle of the blade with reference to the path of travel of the grader, while swinging the circle draw bar in a vertical plane about its forward end changes the vertical position of the grader blade with reference to the ground.

In addition, the grader blade is mounted on a horizontal axis so that it may be tipped with respect to the circle by hydraulic cylinder and piston means to change the angle of attack of the blade and it may also be shifted endwise in its mounting.

While the grader blade must be mounted for tilting movement and for lateral shifting movement as above described, it is essential that in operation the blade be securely locked against movement. Surface tolerance requirements are becoming increasingly restricted both in highway construction and in the preparation of other construction sites where concrete is to be laid on the ground. Thus, for example, the minimum thickness of concrete in a road must be maintained for the proper strength, which requires an accurate subgrade. Present day grading tolerances for such work may restrict subgrade surface variations to a small fraction of an inch. This, of course, requires very accurate locking of the blade in any desired working position.

Further, the lock and the blade must cooperate in such a way that releasing the lock to permit side shifting of the blade does not permit the blade to shift in its mounting and thus cause a variation in the graded surface.

The most pertinent prior art of which applicant is aware is disclosed in U.S. Pat. No. 3,593,806.

SUMMARY OF THE INVENTION

The principal object of the invention is to provide improved motor grader blade clamping mechanism.

Another object of the invention is to provide motor grader blade clamping mechanism which cooperates with an improved motor grader blade and blade support structure to provide for clamping and releasing the blade without shifting the blade in its supports.

Still another object of the invention is to provide a blade clamping mechanism which clamps the blade firmly against vertical movement and against horizontal fore-and-aft movement while placing minimum stresses upon the blade and the blade supporting means.

In the present structure a clamp lever has a short clamp arm and a long input arm so as to provide a high mechanical advantage for bearing against the lower grader blade support rail from below, in order to clamp the rail against overlying confining means in the blade support means so as to have high clamping force in a vertical direction; while at the same time a clamp shoe bears against the back of the upper blade support rail with direct hydraulic cylinder and piston unit actuation affording no mechanical advantage. A single hydraulic cylinder and piston unit moves the clamp shoe and the clamp lever.

The foregoing system which uses a lever with high mechanical advantage can produce, for example, a force of approximately 19 tons; and this force is applied directly through the lower rail and the lower rail support into the depending blade support arms which are integral with the circle. Assuming that blade clamps are used on both sides of the structure, there is a total clamping force of 38 tons against the lower support rail which puts no load upon the grader blade assembly. A hydraulic cylinder and piston unit which produces 19 tons of force at the clamp arm of the lever presses the clamp shoe against the back of the upper support rail with a force of approximately 5 tons. This force, also, is carried directly through the upper blade support rail and the blade support means, with no strain upon the grader blade assembly.

The specific structure here disclosed for the clamping mechanism is so designed that it may be readily applied to a motor grader as an attachment with a minimum amount of modification of the basic blade support means and related parts of the motor grader mechanism.

THE DRAWINGS

FIG. 1 is a side elevational view of a motor grader embodying the invention;

FIG. 2 is a perspective view of a subassembly consisting of a circle mounting bar, a circle, grader blade assembly and mounting, and a blade clamping mechanism which embodies the present invention;

FIG. 5 is a hydraulic circuit diagram of the control circuit for the clamping mechanism.

DETAILED DESCRIPTION OF THE INVENTION

Figure 3:
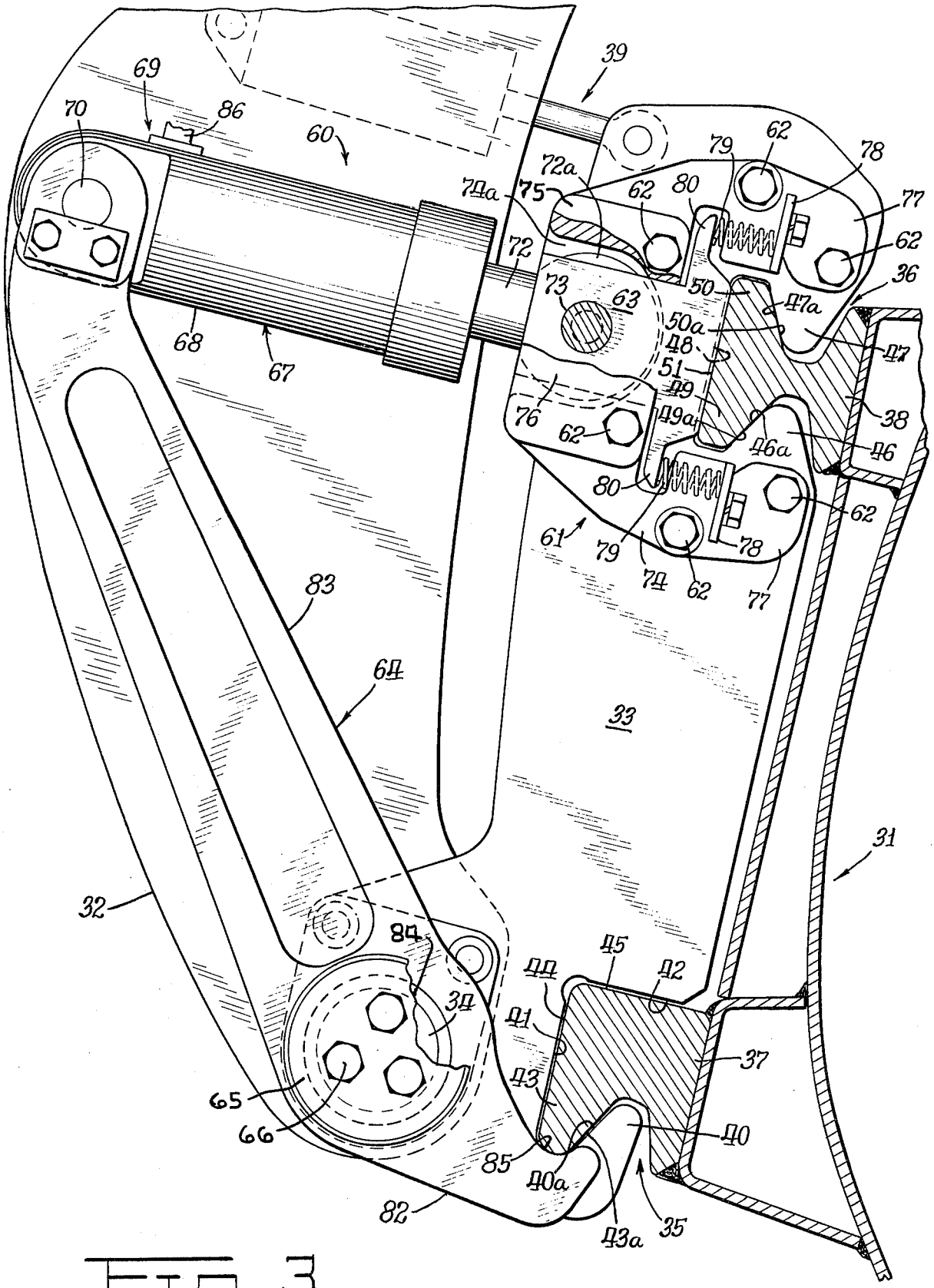
FIG. 3 is a fragmentary sectional view on an enlarged scale, taken substantially as indicated along the line III—III of FIG. 2, with the clamping mechanism of the present invention in clamped position.

Referring first to FIG. 1 of the drawings, a motor grader, indicated generally at 10, includes a longitudinal main frame 11 the front end 11*a* of which is supported upon a dirigible front wheel assembly 12, and the rear end of which constitutes part of a traction chassis, indicated generally at 13, on which is mounted a power plant, indicated generally at 14. An operator's cab, indicated generally at 15, is on the rear portion of the main frame, forward of the traction chassis. A grader blade subassembly, indicated generally at 16, consists generally of a circle mounting bar, indicated generally at 17, which in the illustrated apparatus is a draw bar; a circle structure, indicated generally at 18; and a grader blade and blade mounting, indicated generally at 19.

The circle draw bar 17 is best seen in FIG. 2 to include a forward beam, indicated generally at 20, and a rearward circle carrying structure, indicated generally at 21, the forward part 22 of which is integral with the rear end of the beam 20. Behind the part 22 of the carrying structure said carrying portion has a section 23 the depth of which is great enough that it forms a housing extending below the circle 18. The housing section 23 receives drive means, indicated generally at 24. The housing section 23 of the circle draw bar merges into a nearly semi-annular upright wall 25 which is part of an internal housing for the circle 18, and integral with the wall 25 is horizontal top wall 26.

The subassembly 16 is mounted under the main frame 11 by means of a front mounting element and rear mounting elements which engage with cooperating elements carried upon the main frame. At the front end 20*a* of the circle draw bar is a ball 28 which forms part of a ball and socket connection (not shown) by means of which the front of the circle draw bar is connected for universal movement on the front end 11*a* of the main frame. At the back end of the housing section 23 of the rearward circle draw bar portion 21 is a pair of aligned, laterally extending upright plates 29 which are provided with balls 30 that make ball and socket connections with fittings (not shown) on the lower ends of a pair of hydraulic cylinder and piston units 30*a* which are carried upon the main frame 11. Thus, operation of the hydraulic cylinder units 30*a* swings the circle draw bar 17 about the ball and socket connection including the ball 28, which in this respect provides a horizontal pivot axis. A ball 30*b* on one of the webs 29 provides for a ball and socket connection with a side-shift cylinder (not shown) which shifts the draw bar sideways, with the ball 28 providing a vertical pivot axis.

Referring now to FIG. 3, the grader blade and blade mounting 19 includes a grader blade assembly, indicated generally at 31, which is carried upon blade support arms 32 that are integral with the rear portion of the circle structure 18, and there being blade support means consisting of bearing housings 33 which are mounted on transverse pivots 34 on the arms 32. Each of the bearing housings 33 has a forwardly open lower jaw 35 and a forwardly open upper jaw 36 in which a lower blade support rail 37 and an upper blade support rail 38 are respectively mounted for longitudinal sliding movement; and the tilt of the housings 33 about their pivots 34 is controlled by a pair of hydraulic cylinder and piston units, indicated generally at 39.

The lower jaw 35 has a front lower confining web 40, a planar rear confining surface 41, and a planar top confining surface 42 which are generally complementary to an arcuate land 43 which extends the entire length of the bottom of the lower support rail 37, a planar rear surface 44 and a planar top surface 45 of said rail 37. An inclined rear surface 40*a* of the flange 40 cooperates with an inclined forward surface 43*a* of the land 43 and the planar surfaces 41 and 44 to seat the lower support rail slidably in the open lower jaw 35.

The open upper jaw 36 has a front lower flange 46 that has an inclined rear surface 46*a;* and there is also a front upper flange 47 which has an inclined rear face 47*a;* and the upper jaw 36 has a planar back surface 48. The upper support rail 38 has a lower land 49 with an inclined surface 49*a* which matches the surface 46*a*, and an upper land 50 with an inclined surface 50*a* which matches the face 47*a*, and a planar back surface 51 on the rail 38 matches the planar back surface 48 of the jaw 36. Thus, the jaw surfaces 46*a*, 47*a* and 48 act as confining surfaces or the rail 38 by their sliding engagement with the rail surfaces 49*a*, 50*a* and 51.

It is apparent that the confining surfaces of the lower jaw 35 and the upper jaw 36 restrict both vertical movement and fore-and-aft movement of the rails 37 and 38 in the support means 33 while leaving the rails free to slide endwise in the jaws for lateral adjustment of the blade assembly 31 by a cylinder and piston unit which is indicated generally at 52 in FIG. 2 where only the piston rod of the unit is visible.

The improved blade clamping mechanism of the present invention is indicated generally at 60, and it is so constructed that it may be mounted as an accessory upon a motor grader 10. The clamping mechanism 60 consists generally of a clamp shoe bracket, indicated generally at 61, which is secured in a position behind the upper support rail 38 by means of machine screws 62 which screw into threaded blind bores in the side of the blade support member 33; a clamp shoe, indicated generally at 63, which is mounted for sliding movement in the bracket 61; a clamp lever, indicated generally at 64, which is journalled on a laterally extending end portion of the pivot pin 34 and which is held in place by retaining plate 65 that is fastened to the end of the pivot pin 34 by three machine screws 66; and a hydraulic ram, indicated generally at 67, which includes a cylinder 68 which has a head end 69 pivotally connected at 70 to the upper end of the clamp lever 64, and a piston 71 which has a piston rod 72 pivotally connected to the clamp shoe 63 at 73.

As best seen in FIG. 3, the bracket 61 includes a base plate 74, and a retaining plate 75 which is detachably secured to the rearward portion of the bracket base plate 74 has an elevated central portion 76 which overlies a recess 74*a* in the base plate in which is received an eye 2*a* on the end of the piston 72 which rotatably surrounds the pivot 73 to make the connection between the clamp shoe 63 and the ram piston 72. The plate 74 has forward portions 77 which are above and below the upper jaw 36, and there are integral, laterally extending flanges 78 on the two forward portions 77 which serve as spring seats for compression springs 79 which are confined between said spring seats and integral arms 80 at the forward end of the clamp shoe 63. Between the arms 80 the clamp shoe has a planar clamp surface 81 which bears against the planar rear surface 51 of the upper support rail 38 when the clamp mechanism 60 is in the clamping position illustrated in FIG. 3.

The clamp lever 64 consists of a short clamp arm 82 and a long input arm 83 which extend in opposite directions from the fulcrum of the clamping lever 64 which is afforded by the bushing 84 which is fixed in the clamp lever 64 and journalled upon the pivot pin 34. The clamp arm 82 of the clamp lever 64 has an arcuate contacting surface 85 which is generally complementary to the rounded lower end of the land 43 at the underside of the lower support rail 27, so that when the clamp mechanism 60 is in its clamping position of FIG. 3 there is a substantial area of contact between the rounded lower surface of the land 43 and the arcuate contacting surface 85 of the clamp arm 82.

Figure 4:
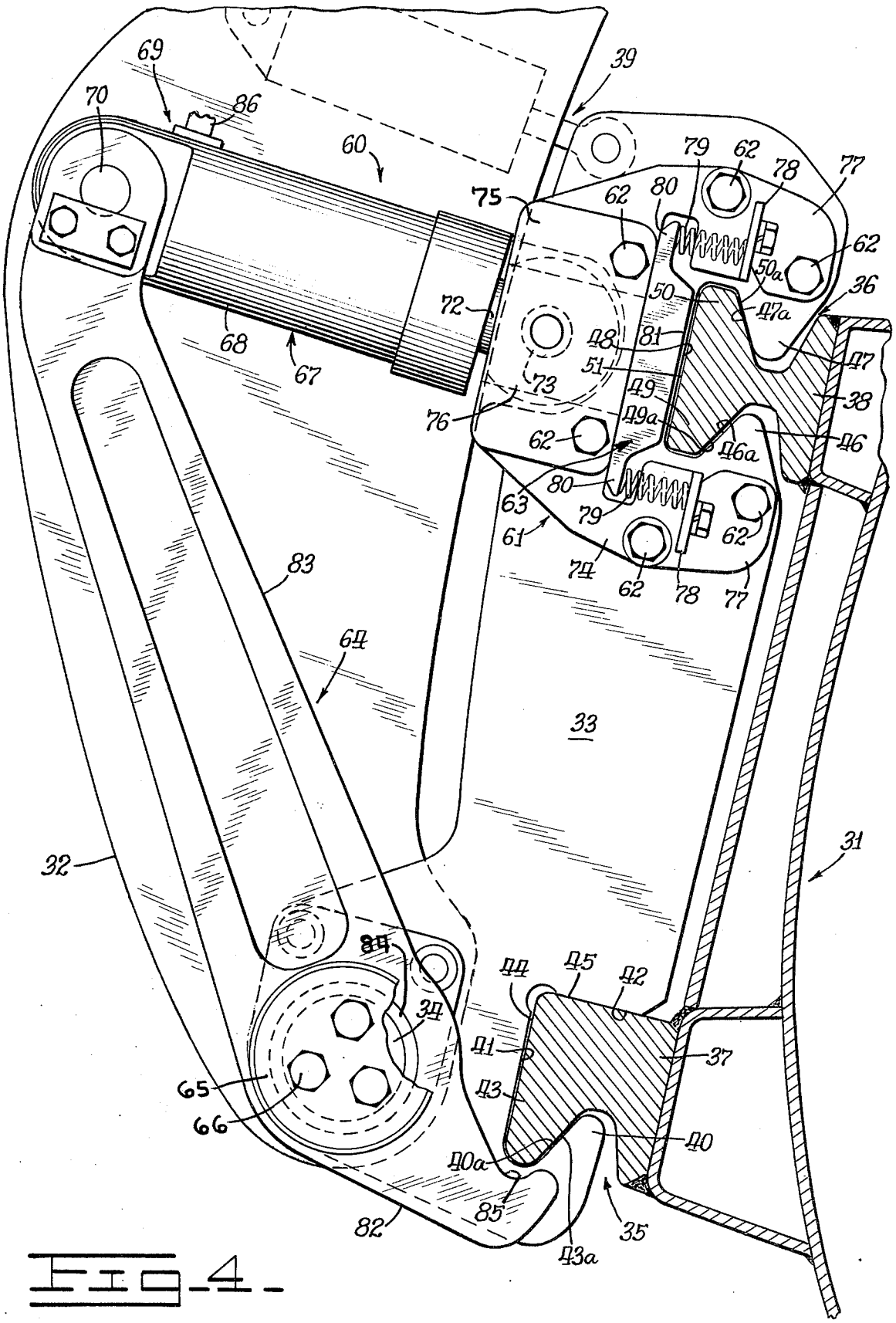
FIG. 4 is a view like FIG. 3 with the clamping mechanism is released position.

The hydraulic ram 67 is of a single action type which has a hydraulic line 86 at its head end 69; and as seen in FIG. 5 the line 86 is part of a hydraulic circuit which includes a sump 87, a pump 88, a valve 89, a pressure line 90 and a return line 91, both of which connect with the line 86 through the valve 89. As indicated in the drawings, the valve 89 has a spring 92 which normally retains it in the position illustrated in FIG. 5 with the ram supply line 86 open to pressure from the line 90 so that the mechanism 60 ordinarily occupies the clamping position of FIG. 3. A manual valve actuating lever 93 the valve from the position of FIG. 5 to a position in which the ram supply line 86 is open to the return line 91, so that the action of the compression spring 79 upon the clamp shoe 63 may move the hydraulic ram 60 from the clamping position of FIG. 3 to the release position of FIG. 4. When this has been done the operator of the motor grader 10 can actuate the hydraulic cylinder and piston unit 52 in order to shift the blade assembly 31 laterally. When the operator releases the manual valve operating lever 93, the spring 92 returns the valve 89 to the position of FIG. 5 in which pressure is applied to the ram position 71 to return the clamp mechanism to the clamping position illustrated in FIG. 3.

In the clamping position, the clamp arm 82 of the lever 64 bears against the rounded extremity of the land 43 so as to clamp the lower support rail 37 firmly against the overlying confining surface 42 of the jaw 35; and simultaneously the clamp shoe 63 has its clamp surface 81 pressed against the planar rear surface 51 of the upper support rail 38 so as to clamp the rail surfaces **49*a* and 50*a* firmly against the inclined surfaces 46*a* and 47*a* of the upper jaw 36**; and this firmly locks the upper support rail against fore-and-aft movement.

The mechanical advantage afforded by the clamp lever 64 is sufficient that a hydraulic ram 67 which applies a clamping force of approximately 5 tons to the back surface of the upper support rail 38 causes the clamp arm 82 to apply approximately 19 tons pressure to the lower support rail 37. This is ample to firmly anchor the grader blade assembly 31 during a grading operation; but the clamping force against the relatively weak flanges 46 and 47 of the upper jaw is only a small fraction of the force against the very strong lower portion of the blade support means 33.

Although only one clamp mechanism 60 is illustrated in the drawings, ordinarily a second clamp mechanism (not shown) is mounted to the outside of the left hand support arm 32 seen in FIG. 2. Therefore, of course, both of the clamp mechanisms 60 have their hydraulic rams 67 connected by hydraulic lines with the valve 89 so that the two hydraulic rams are released and applied simultaneously by operation of the manual control lever 93.

The foregoing detailed description is given for clearness of understanding only and no unnecessary limitations should be understood therefrom as modifications will be obvious to those skilled in the art.

What is claimed is:

1. In a motor grader which has a circle with depending blade support arms, blade support means mounted on said arms on transverse pivots, a grader blade assembly which includes a lower support rail and an upper support rail carried in said blade support means for lateral sliding movement between confining surfaces which restrict vertical and fore-and-aft movement of the rails in the support means, and a hydraulic ram for shifting the blade assembly laterally in the support means, a blade clamping mechanism comprising, in combination:

a clamp shoe bracket on the blade support means behind the upper support rail;

a clamp shoe mounted on said bracket for movement between a release position spaced slightly from the upper support rail and a clamping position bearing against the rear of said upper support rail;

a clamp lever pivoted on the blade support means directly behind the lower support rail, said lever leaving having a long input arm with a free end directly behind the clamp shoe, and said lever having a short clamp arm in the vertical plane with the lower support rail;

a hydraulic ram which has a cylinder operatively connected to the input arm and a piston with a piston rod operatively connected to the clamp shoe;

and means for applying hydraulic pressure to the piston of said ram, movement of the pisiton in one direction acting to move the clamp shoe to clamping position and pivot the clamp lever to force the clamp arm against one of the vertical confining surfaces of the blade support means, and movement of the piston in the other direction acting to release the clamp shoe and the clamp arm from said rails.

2. The combination of claim 1 in which the clamp arm is beneath the lower support rail and forces said lower support rail against a confining surface which overlies said lower support rail.

3. The combination of claim 2 in which the movement of the piston to extend the piston rod moves the clamp shoe to locking position.

4. The combination of claim 3 in which the hydraulic ram is single acting, and which includes spring means normally urging the clamp shoe to release position.

5. The combination of claim 4 in which the clamp shoe has integral arms, integral flanges on the bracket provide spring seats, and a plurality of compression springs are confined between said spring seats and the arms.

6. The combination of claim 4 in which the means for applying hydraulic pressure comprises a source of fluid under pressure, a sump, a pressure line from said source to the head end of the cylinder, a return line from said head end to the sump a valve for said lines which is normally open to the pressure source and closed to the sump, and a manual control lever for moving said valve to close the line to the pressure source and open the line to the sump.

7. The combination of claim 1 in which hydraulic pressure on the piston holds the clamp shoe and the clamp arm normally in clamping position.

8. The combination of claim 7 in which the means for applying hydraulic pressure comprises a source of fluid under pressure, a sump, a pressure line from said source to the cylinder, a return line from the cylinder to the sump, a valve for said lines which is normally open to the pressure source and closed to the sump, and a manual control lever for moving said valve to close the line to the pressure source and open the line to the sump.

9. The combination of claim 8 in which the hydraulic ram is single acting, and which includes spring means normally urging the clamp shoe to release position.

10. The combination of claim 2 in which the lower support rail has a bottom surface with an arcuate land extending its entire length, and the clamp arm has a contacting surface complementary to said land which affords a substantial area of contact between said land and said contacting surface.

11. The combination of claim 10 in which the lower support rail has a planar upper surface which is forced against a planar surface in the blade support means.

12. The combination of claim 11 in which the upper support rail has a planar rearward surface and the clamp shoe has a planar forward surface.

13. The combination of claim 1 in which the clamp lever is journalled on a projecting end portion of the transverse pivot for the blade support means, a retaining flange overlies the clamp lever and is secured to said transverse pivot, and the clamp shoe bracket is detachably secured to a side of the blade support means.

14. The combination of claim 1 in which the piston of the hydraulic ram is directly operatively connected to the clamp shoe.

* * * * *

UNITED STATES PATENT AND TRADEMARK OFFICE

CERTIFICATE OF CORRECTION

PATENT NO. : 4,037,670

DATED : July 26, 1977

INVENTOR(S) : Robert Allan Atherton and Carroll Richard Cole

It is certified that error appears in the above-identified patent and that said Letters Patent are hereby corrected as shown below:

Col. 1, line 12, after "1976" insert --now U. S. Patent No. 4,015,669 issued April 5, 1977--;
Col. 2, line 66, "is" should be --in--;
Col. 4, line 19, "or" should be --for--;
Col. 4, line 54, "2a" should be --72a--;
Col. 5, line 22, after "93" insert --moves--;
Col. 6, line 23, cancel "leaving";
Col. 6, line 25, after "the" (first occurrence) insert --same--;
Col. 6, line 33, after "and" insert --to--;
Col. 6, line 42, cancel " the" (second occurrence);
Col. 6, line 57, after "sump" insert a comma.

Signed and Sealed this

*Twenty-second* Day of *November 1977*

[SEAL]

*Attest:*

RUTH C. MASON
*Attesting Officer*

LUTRELLE F. PARKER
*Acting Commissioner of Patents and Trademarks*